US008833929B2

(12) United States Patent
Obata et al.

(10) Patent No.: US 8,833,929 B2
(45) Date of Patent: Sep. 16, 2014

(54) IMAGE FORMING APPARATUS

(75) Inventors: Yuzoh Obata, Tokyo (JP); Masanori Namba, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/570,604

(22) Filed: Aug. 9, 2012

(65) Prior Publication Data

US 2013/0038663 A1 Feb. 14, 2013

(30) Foreign Application Priority Data

Aug. 11, 2011 (JP) ..... 2011-175619
Nov. 11, 2011 (JP) ..... 2011-248117

(51) Int. Cl.

| | |
|---|---|
| ***B41J 2/01*** | (2006.01) |
| ***B41J 13/02*** | (2006.01) |
| ***B41J 25/34*** | (2006.01) |
| ***B41J 11/00*** | (2006.01) |
| ***B41J 25/308*** | (2006.01) |

(52) U.S. Cl.

CPC ..... *B41J 13/025* (2013.01); *B41J 25/34* (2013.01); *B41J 11/007* (2013.01); *B41J 25/308* (2013.01)

USPC ..... 347/104

(58) Field of Classification Search

CPC ..... B41J 11/07

See application file for complete search history.

(56) References Cited

U.S. PATENT DOCUMENTS

| | | | | |
|---|---|---|---|---|
| 2006/0132574 | A1 | 6/2006 | Kawabata | |
| 2006/0187504 | A1* | 8/2006 | Kawashima | 358/497 |
| 2007/0048010 | A1* | 3/2007 | Nakano | 399/121 |
| 2007/0171253 | A1* | 7/2007 | Kudoh et al. | 347/29 |
| 2008/0073185 | A1* | 3/2008 | Brayman et al. | 198/860.2 |
| 2009/0185813 | A1* | 7/2009 | Hagiwara et al. | 399/16 |

FOREIGN PATENT DOCUMENTS

| | | |
|---|---|---|
| JP | 4-53256 | 5/1992 |
| JP | 6-110261 | 4/1994 |
| JP | 2006-176261 | 7/2006 |
| JP | 2006-301335 | 11/2006 |
| JP | 2010-221546 | 10/2010 |
| JP | 2011-31606 | 2/2011 |

OTHER PUBLICATIONS

U.S. Appl. No. 08/125,766, filed Sep. 24, 1993, Tsuyoshi Deki et al.

* cited by examiner

*Primary Examiner* — Shelby Fidler
(74) *Attorney, Agent, or Firm* — Cooper & Dunham LLP

(57) ABSTRACT

An image forming apparatus includes a carriage to mount a recording head which discharges a liquid droplet on a recording medium to form an image, a carriage guide member to support the carriage and move the carriage to scan in a main scanning direction orthogonal to a sub-scanning direction in which the recording medium is conveyed, and a recording medium conveyance unit detachably mounted to a main body of the apparatus which includes an endless conveyance belt to convey the recording medium being adsorbed on the belt, and a pair of rollers around which the conveyance belt is extended circulating in the sub-scanning direction. The carriage is cantilevered by the carriage guide member, and the recording medium conveyance unit is removable from a space above the conveyance belt, in an area other than the carriage guide member.

11 Claims, 18 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Applications No. 2011-175619, filed on Aug. 11, 2011, and No. 2011-248117, filed on Nov. 11, 2011, in the Japan Patent Office, the entire disclosure of which is hereby incorporated herein by reference.

FIELD OF THE INVENTION

This invention relates to an image forming apparatus.

BACKGROUND OF THE INVENTION

Image forming apparatuses such as printers, facsimiles, copiers, plotters, and multifunction apparatuses that print, fax, copy, and so on, also include an ink jet recording apparatus, which includes a liquid droplet discharge head to discharge ink liquid droplets to perform image forming on a recording medium.

In the ink jet recording apparatus disclosed in JP 2006-301335A, as shown in FIG. 1, an image is formed by discharging an ink on a sheet of paper 203 that is the recording medium while a carriage 202 is moved to scan the recording medium in a main scanning direction (a direction shown by the double-headed arrow "b" in FIG. 1). The carriage 202 is slidably supported in the main scanning direction by two guide rods, a main guide rod 205 and a secondary guide rod 206, extending between the left and right side plates 204A and 204B. The carriage 202 is moved to scan in the main scanning direction by a primary scanning motor, not shown, through a timing belt, not shown, perpendicular to a sub-scanning direction in which the recording medium 203 is conveyed (a direction indicated by the arrow "a" in FIG. 1).

The carriage 202 includes recording heads 201, which discharge liquid droplets of black ink (K), cyan ink (C), magenta ink (M), and yellow ink (Y), a circuit board, not shown, to provide a drive signal to the recording head 201, and a recording head unit incorporating the recording heads 201 and sub tank 207 to store the ink to be supplied to the recording heads 201. Each color ink is supplied to the sub-tank 207 of the recording head 201 from the ink cartridge 209 for each color through the supply tube 208 for each color. In order to send the recording medium 203 fed from a recording medium feed unit, not shown, to the lower side of the recording head 201, an electrostatic conveyance means which, in the present invention, is a conveyance belt 210 adsorbs the recording medium 203 electrostatically and conveys it to a position facing the nozzle surface of the recording head 201.

The conveyance belt 210 is an endless belt entrained around the conveyance roller 211 and the tension roller 212 that circulates in the sub-scanning direction shown by arrow "a" in FIG. 1. The conveyance belt 210, the conveyance roller 211 and the tension roller 212 and a holding member that holds the conveyance roller 211 and the tension roller 212 around which the conveyance belt 210 is entrained together form a conveyance belt unit. Further, a charging roller, not shown, that charges the surface of the conveyance belt 210 is provided. The charging roller is disposed to contact the front layer of the conveyance belt 210 and is driven to rotate to follow the rotation of the conveyance belt 210. As shown in FIG. 2A, positioning in the main scanning direction and the sub-scanning direction is carried out by fitting the roller shaft of the conveyance roller 211 to the bearing member 213. The roller shaft of the tension roller 212 is engaged with the bearing member 214 in a direction perpendicular to the axis. The conveyance belt is circulated to move in the belt conveyance direction by rotating the conveyance roller 211 to rotate with a sub scanning motor, not shown, through the timing belt. In order to maintain the landing position of ink discharged from the recording head onto the recording medium, or avoid damage due to contact of the recording head with the recording medium, the electrostatic adsorption conveyance means conveys the recording medium while keeping a predetermined short distance between the recording head and the recording medium.

The surface of the conveyance belt gets dirty and is damaged by scattering ink, paper particles, dust generated while printing and wear and tear of the conveyance belt. Then, the adsorption performance of the recording medium is degraded, necessitating replacement of the conveyance belt.

Replacement of the conveyance belt is as follows: In the ink jet recording apparatus disclosed in JP-2011-031606-A, as shown in FIG. 2A, the primary guide rod 205 and the secondary guide rod 206 are provided in a space above the conveyance belt 210 of the conveyance belt unit. On the primary guide rod 205, the carriage 202 is slidably mounted via a mounting member 215. When the belt conveyance unit is mounted and removed, the mounting member 215 is removed at the beginning. On the other hand, since only a part of the carriage 202 is suspended to the secondary guide rod 206, the carriage 202 can be removed upward from each guide rod. When the conveyance belt unit is removed after removing the carriage 202, as shown in FIG. 2B, there is almost no space between the primary guide rod 205 and secondary guide rod 206 disposed above the conveyance belt 210 and the conveyance belt 210. Accordingly, the two guide rods disturb the movement of the conveyance roller 211 so that the conveyance roller 211 cannot be removed from the bearing unit 213. As a result, it is difficult to remove the conveyance belt unit from the main body of the apparatus only by removing the carriage 202.

It is conceivable that the two guide rods can be removed from the main body of the apparatus, however, it is necessary to remove the fixed member provided at both side surfaces and other units of apparatus to remove the two guide rods, which is complicated and time-consuming.

In addition, the image forming apparatus disclosed in JP 2006-301335A described above includes a spur holder including a spur roller supported by an elastic body, such as a spring, to oppose to a recording medium output roller. Since the spur roller contacts the surface of the recording medium with a point contact, the contact area with the recording medium surface (image surface) is minimized, and accordingly, the trace of the spur rollers is reduced to be the minimum while maintaining the power to convey the recording medium, thereby, preventing image forming failure from occurring.

However, in the image forming apparatus disclosed in JP 2006-301335A, the spur holder is moved between a retracted position and an engaged position for each piece of recording medium, accordingly, there is a possibility that the spur holder may not be moved to the retracted position or the engaged position correctly due to the aging of a solenoid or a spring, etc. of the spring moving system. When the spur holder is moved excessively to the engaged position, the spur roller contacts the recording medium deeply to press the recording medium excessively so that traces of the spur roller remain.

Further, since the spur holder is mounted in the moving means by fastening means such as a screw, etc., the spur holder should be removed from the moving means when the spur holder is exchanged. Accordingly, it is not easy to exchange the spur holder.

The present invention is conceived in the view of the problems described above, therefore, and provides an image forming apparatus in which the replacement of the spur holder is easy and moreover prevents the image forming failure due to the trace of the spur roller on the recording medium from occurring.

SUMMARY OF THE INVENTION

An image forming apparatus includes a carriage to mount a recording ink head which discharges a liquid droplet on a recording medium to form an image, a carriage guide member to support the carriage and move the carriage to scan in a main scanning direction orthogonal to a sub-scanning direction in which the recording medium is conveyed, and a recording medium conveyance unit detachably mounted to a main body of the apparatus which includes an endless conveyance belt to convey the recording medium being adsorbed on the belt, and a pair of rollers around which the conveyance belt is extended circulating in the sub-scanning direction. The carriage is cantilevered by the carriage guide member, and the recording medium conveyance unit is removable from a space above the conveyance belt, in an area other than the carriage guide member.

The recording medium conveyance unit may be removable from the driven roller side of the recording medium conveyance unit.

The recording medium conveyance unit may include a protruding portion that protrudes from an outer peripheral portion of the conveyance belt.

The above-described image forming apparatus may further include a fastening member to fasten the recording medium conveyance unit to a part of a main body of the apparatus in a direction substantially identical to a direction in which the recording medium conveyance unit is detachable.

A fastening portion to fasten the recording medium conveyance unit with the fastening member to a part of a main body of the apparatus may be elastic.

The fastening member may be one of a screw and a snap fitting having a nail shape.

The above-described image forming apparatus may further include a recording medium output roller to output a recording medium on which an image is formed by discharging a recording liquid onto the recording medium, a spur holder, a spur roller provided opposite to the recording medium output roller in a spur holder and supported by an elastic body to output the recording medium together with the recording medium output roller, and a boss and an attachment hole engaging the boss. When the attachment hole is provided at a part of the conveyance roller holding member which holds a pair of rollers at a position corresponding to the boss, the boss may be provided on a side of the snap fit nail which is elastic and provided in the spur holder, or when the boss is provided at a part of the conveyance roller holding member, the snap fit nail which is elastic and has the engagement hole may be provided on a side of the spur holder.

The above-described image forming apparatus may further include a recording medium output roller holding member to hold the recording medium output roller, a positioning member provided in one of a part of the recording medium output roller holding member and a part of the conveyance roller holding member, and a regulation member to regulate a swinging position around the boss and the attachment hole by catching the positioning member.

The regulation member may have a rail shape and includes a retainer to retain the positioning member.

The spur holder may be removed and attached by sliding the retainer having a rail shape in the conveyance direction.

BRIEF DESCRIPTION OF THE DRAWINGS

A more complete appreciation of the invention and many of the advantages thereof may be obtained as the same become better understood by reference to the following detailed description when considered in connection with the accompanying drawings, wherein.

DETAILED DESCRIPTION OF THE INVENTION

Embodiments of the present invention are described below with reference to the accompanying drawings.

Figure 1:
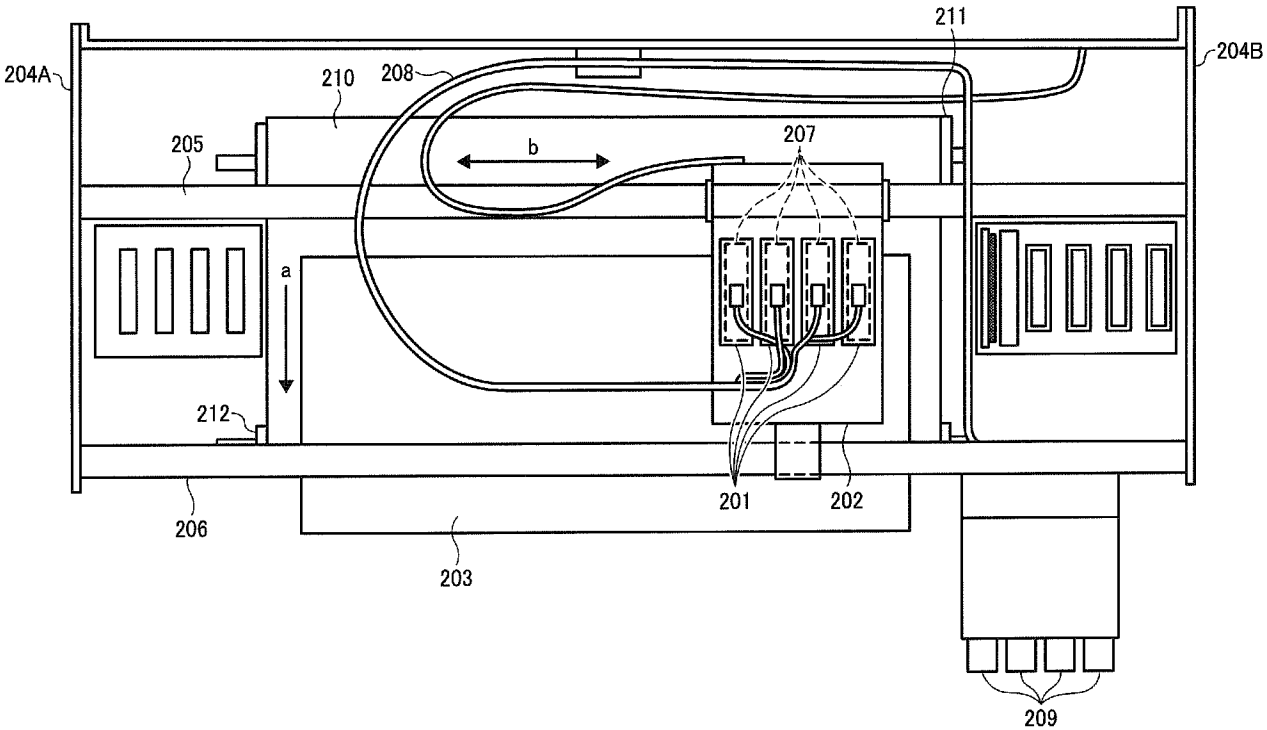
FIG. 1 BACKGROUND ART
FIG. 1 is a schematic plan view of a configuration of the conventional ink jet recording apparatus.
Figure 2A:
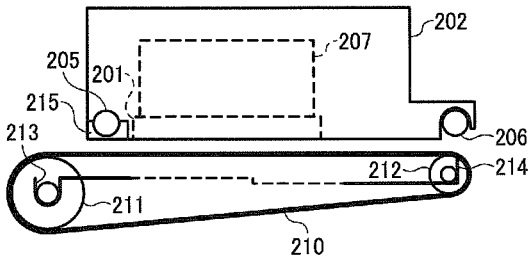
FIG. 2A BACKGROUND ART
FIGS. 2A and 2B are schematic sectional views showing a detaching process of the conveyance belt unit in the conventional ink jet recording apparatus.
Figure 2B:
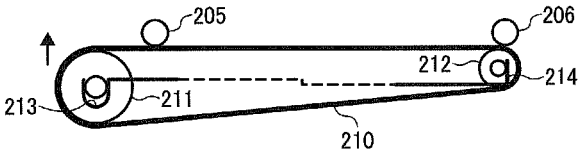
FIG. 2B BACKGROUND ART
Figure 3:
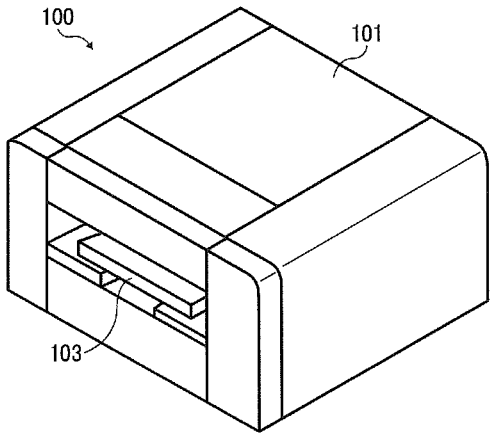
FIG. 3 is a perspective view of an embodiment of an image forming apparatus according to the present invention.
Figure 4:
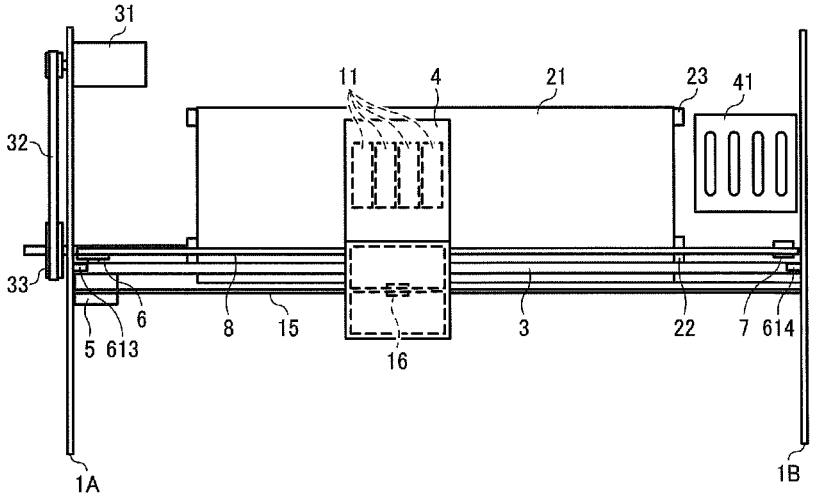
FIG. 4 is a plan view of a main part of the mechanical unit of the image forming apparatus.

FIG. 3 is a perspective view showing an embodiment of an image forming apparatus according to the present invention. FIG. 4 is a plan view of a mechanical unit of the image forming apparatus.

As shown in FIG. 3, the image forming apparatus of the embodiment is a serial type image forming apparatus, and includes a cover 101 openably closable on the top surface of the main body 100 of the apparatus. It is possible to access the internal mechanism by opening the cover 101. In front of the main body 100 of the apparatus, a recording medium output tray 103 is provided to output the recording medium on which an image is formed.

As shown in FIG. 4, the mechanical unit slidably supports the carriage 4 in the main scanning direction with the carriage guide member 3 extending between left and right side plates 1A and 1B, and moves the carriage 4 to scan in the main scanning direction via the timing belt 8 being extended among a drive pulley 6 and a driven pulley 7 by a main scanning motor 5.

The carriage 4 includes image forming means, which, in the present embodiment, are liquid droplet discharge heads to discharge liquid droplets of each color, yellow (Y), cyan (C), magenta (M), Black (K). The carriage 4 also holds a recording head unit 11 including head tanks to supply ink to the liquid discharge heads (hereinafter refer simply as "recording head") including a nozzle array formed of multiple nozzles arranged in the sub-scanning direction perpendicular to the main scanning direction so that the droplet discharge direction is downward. A plurality of the recording heads 11 is held with a head holder (not shown) to be unitized so that the plurality of the recording heads 11 is mounted on the carriage 4.

Further, the encoder scale 15 is placed along the main scanning direction of the carriage 4. At the side of the carriage 4, an encoder sensor 16 formed of a transmission type photo sensor to read the scale of the encoder scale 15 (scale: position identification unit) is attached, the encoder scale 15 and the encoder sensor 16 form a linear encoder as a position detection device.

Meanwhile, at the lower part of the carriage 4, a conveyance belt 21 is provided as the conveyance means which conveys the recording medium (not shown) in the sub-scanning direction. The conveyance belt 21 is an endless belt, is extended around a conveyance roller 22 and a tension roller 23, and circulates in the sub-scanning direction in accordance with the rotation of the conveyance roller 22 driven by the sub-scanning motor 31 through a timing belt 32 and a timing pulley 33.

Further, a maintenance mechanism 41 is provided to maintain and recover the condition of the recording head 11 at the side of the conveyance belt 21 on one side of the main scanning direction of the carriage 4. Further, the maintenance mechanism 41 is constructed of, for example, a cap member for capping the nozzle surface of the recording head 11 (the surface on which the nozzle is formed), a wiper member to wipe the nozzle surface, and a blank discharge receiver to receive the liquid droplets which do not contribute to the image forming.

The conveyance belt 21 shown in FIG. 4 and the recording medium output tray 103 shown in FIG. 3 are mounted detachably to the main body 100 of the image forming apparatus.

In the image forming apparatus according to the present invention having such a configuration, the fed recording medium is conveyed intermittently by the conveyance belt 21, and the recording head 11 is driven in accordance with an image signal while the carriage 4 is being moved in the main scanning direction. In this process, a single line is recorded by discharging of the liquid droplets on the recording medium being halted, then, after conveying the recording medium by a predetermined amount, a next single line is recorded in the same way. The process is repeated so as to form an image on the recording medium, after which the recording medium is output.

Figure 5:
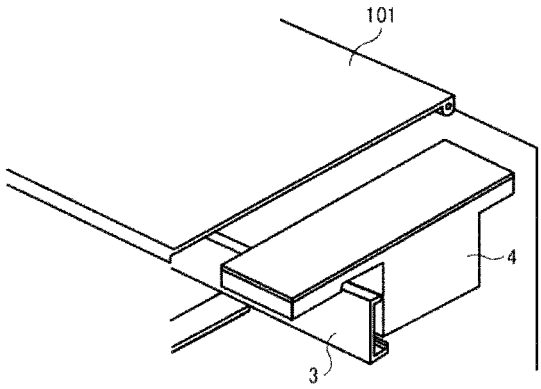
FIG. 5 is a perspective view of a main part of the mechanical unit.
Figure 6:
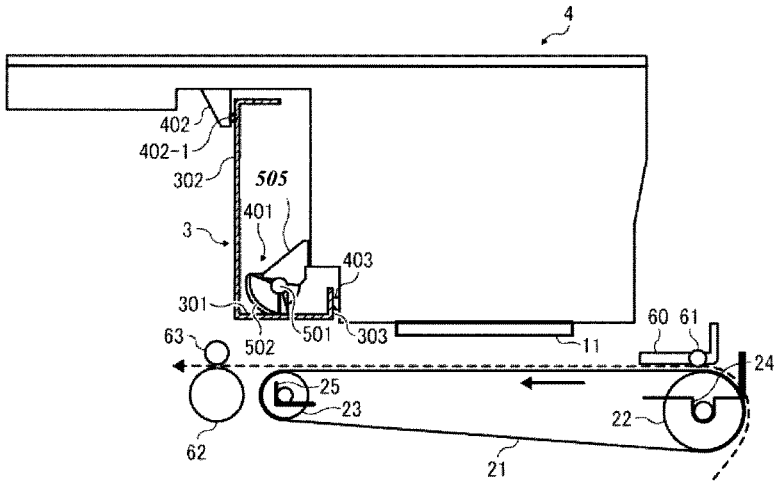
FIG. 6 is a side view of a carriage.
Figure 7:
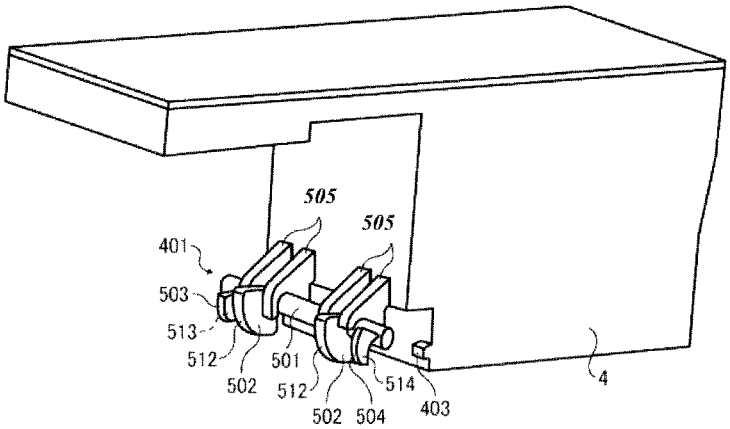
FIG. 7 is a perspective view of the carriage.
Figure 8:
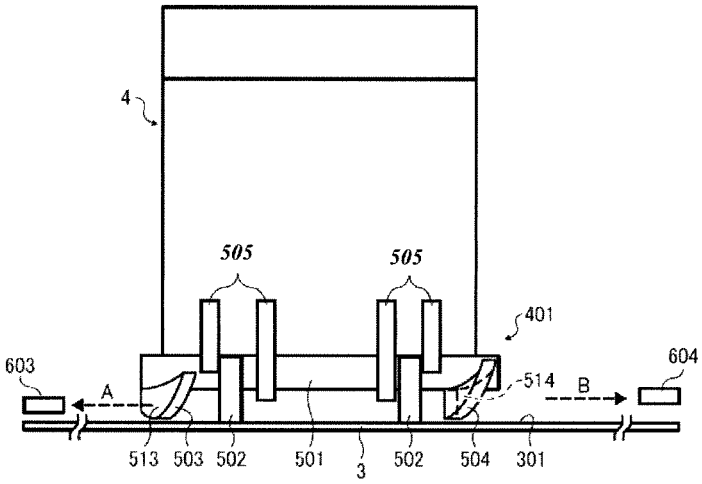
FIG. 8 is a front view of the carriage.

Next, in the image forming apparatus, a support structure and a height adjustment mechanism of the carriage will be described referring to FIGS. 5 through 8. FIG. 5 is a perspective view of a main part of the mechanical unit of the image forming apparatus, FIG. 6 is a side view of the carriage, FIG. 7 is a perspective view of the carriage, and FIG. 8 is a front view of the carriage.

The carriage guide member 3 is formed of sheet metal, and is bent at a right angle in at least two positions in a direction perpendicular to the longitudinal direction of the carriage guide member 3 (the scanning direction of the carriage) to form three outer surfaces and three inner surfaces. The inner surface located in the middle of the three inner surfaces is the bottom surface 301 in the vertical direction directing upward. The two outer surfaces extending in the vertical direction arc the upstream outer surface 303 and the downstream outer surface 302 which face upstream and downstream with respect to the conveyance direction, respectively. The bottom surface 301 determines the height of the carriage 4, and supports the sliding portion 401 including a mechanism for adjusting the height of the carriage 4. A protruding portion 402-I protruding toward the upstream side in the conveyance direction from the sliding portion 402 slidably contacts the downstream outer surface 302. A sliding portion 403 protruding toward the downstream side in the conveyance direction from a part of the carriage 4 slidably contacts the upstream outer surface 303. Further, the upstream outer surface 303 receives a clockwise rotational moment in FIG. 6 due to the weight of the carriage 4, in which the contact point between the protruding portion 402-1 of the sliding portion 402 and the downstream outer surface 302 is the center of the rotational moment. Accordingly, the carriage 4 is cantilevered by the carriage guide member 3. The position of the carriage 4 in the sub-scanning direction is determined by the downstream outer surface302 and the upstream outer surface 303.

Using this configuration, the carriage 4 is cantilevered by the carriage guide member 3. On the upstream side of the conveyance belt 21 in the conveyance direction, a pressure unit 60 having a leading edge pressure roller 61 is provided. On the downstream side of the conveyance belt 21 in the conveyance direction, a recording medium output roller 62 and a spur roller 63 are provided. The recording medium conveyed from the recording medium supply tray is guided between the conveyance belt 21 and the leading edge pressure roller 61, and conveyed by the electrostatic adsorption of the conveyance belt 21. The liquid droplet is discharged from the nozzle on the recording medium being conveyed past the nozzle surface of the recording head 11. The leading edge of the recording medium fed to the downstream side of the conveyance belt 21 is sandwiched by the recording medium output roller 62 and the spur roller 63, and the recording medium is separated from the conveyance belt 21 and conveyed to the recording medium output tray.

Now, a height adjustment mechanism which adjusts the height of the surface of the nozzle from the surface of the conveyance belt according to the thickness of the recording medium is described. The height adjustment mechanism for adjusting for recording mediums of two different thicknesses is described as an example. As for a sliding portion 401 of the carriage 4, a rotary member 501 is rotatably held by four holding members 505 fixed to the carriage 4. The rotary member 501 includes two cam members 502 having sliding surfaces 512 to slidably contact the bottom surface 301, a first rotation induction member 503 having an abutting surface (rotation induction surface, guide surface) formed to be curved at an angle along the main scanning direction, and a second rotation induction member 504 similarly having an abutting surface (rotation induction surface, guide surface) formed to be curved at an angle along the main scanning direction. The first and the second rotation induction members 503 and 504 rotate freely. The first rotation induction member 503 is a height adjustment member for adjusting the height from a first height to a second height. By contrast, the second rotation induction member 504 is a height adjustment member to return the height from the second height to the first height.

When recording medium thickness data is supplied to a main control unit of the main body of the apparatus from a host device before performing the image forming operation, the main control unit performs an adjustment operation to adjust the height of the nozzle surface. For example, when height adjustment operation is performed for recording medium of two different thicknesses as described above, the thickness data of the second recording medium having a thickness thicker than that of the first recording medium is supplied to the main control unit of the main body of the apparatus. The main control unit drives the sub-scanning motor which drives the carriage 4 in the sub-scanning direction to move the carriage 4 in a direction shown by the arrow A in FIG. 8. An abutting surface 513 of the first rotation induction member 503 is placed to touch the top portion of the pin 603 provided on one side plate of the main body of the apparatus (not shown). When the top portion of the pin 603 presses the abutting surface 513 with a predetermined amount of pressure according to the moving amount of the carriage 4, the stress moment created by pressing the pin 603 against the abutting surface 513 being curved at an angle is activated, and the first rotation induction member 503 is rotated a predetermined amount. Then, the rotating member 501 is rotated so that a cam member 502 attached to the shaft of the rotary member 501 is rotated. The bottom 301 is in contact with each support surface 512. A cam member 502 is a circular plate cam in which the distance from the center to circumference is not constant. Accordingly, when the cam member 502 is rotated, a height between the axis position of the rotary member 501 and the bottom surface changes from the first height to the second height. The adjusted height is maintained by the weight of the carriage 4.

On the other hand, when it is adjusted from the second recording medium thickness to the first recording medium thickness, the main control unit drives the sub-scanning motor which drives the carriage 4 in the sub-scanning direction to move the carriage 4 in a direction shown by the arrow B in FIG. 8. An abutting surface 514 of the second rotation induction member 504 is placed to touch the top portion of the pin 604 provided on the other side plate of the main body of the apparatus (not shown). When the top portion of the pin 604 presses the abutting surface 514 with a predetermined amount of pressure according to the moving amount of the carriage 4, the stress moment created by pressing pin 604 against the abutting surface 514 being curved at an angle is activated, and, the second rotating introduction member 504 is rotated in a direction reverse to the rotation direction of the first rotation introduction member 503 a predetermined amount. As the rotating member 501 is rotated in a direction reverse to the rotation direction of the first rotation introduction member 503, the cam member 502 is also rotated in a direction reverse to the rotation direction of the first rotation introduction member 503. Therefore, the height between the axis position of the rotary member 501 and the bottom surface 301 is changed to return from the second height to the first height. Since the carriage guide member is fixed, the carriage 4 is moved up and down where the bottom surface 301 of the carriage member 3 is the base. Accordingly, the nozzle surface of the recording head 11 mounted on the carriage 4 is moved in a vertical direction. In short, the nozzle surface is raised and lowered according to the recording medium thickness data supplied from the host device. Thus, the height of the nozzle surface from the surface of the belt conveyor belt 21 being fixed is adjusted.

Figure 9A:
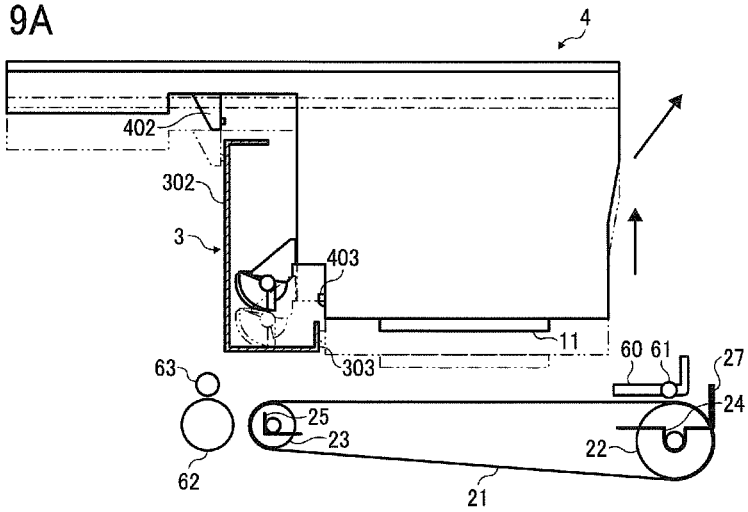
FIGS. 9A, 9B and 9C are schematics showing a procedure to draw out a conveyance belt unit in the image forming apparatus according to the present invention.
Figure 9B:
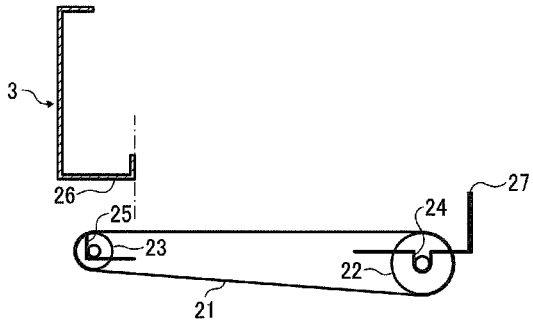
Figure 9C:
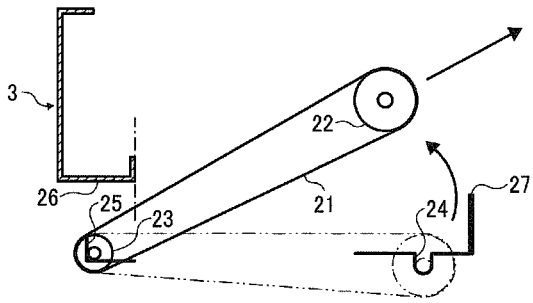

Next, in the image forming apparatus according to the present embodiment, a procedure to remove the conveyance belt unit is described referring to the drawings. FIGS. 9A, 9B and 9C are schematic sectional views showing a procedure to remove the conveyance belt unit. As shown in FIG. 9A, the carriage 4 is removed from the carriage guide member 3 by lifting the carriage 4 up to release a condition in which the two sliding portions 402 and 403 abut the downstream outer surface 302 and the upstream outer surface 303, respectively. Then, the pressure unit 60, the recording medium output roller 62 and the spur roller 63 are removed. After removing these parts, as shown in FIG. 9B, above the conveyance belt 21, an empty space in which the carriage guide member 3 was placed appears. And, as shown in FIG. 9C, a conveyance roller 22 is removed from the bearing member 24. The entire conveyance belt unit is rotated around the tension roller 23 that is a rotation axis so that the conveyance belt unit is drawn out of the apparatus. In the image forming apparatus according to the present invention, as described above, the carriage 4 is supported by the carriage guide member 3 in a cantilever form and is moved to scan, therefore, only one carriage guide member 3 is sufficient. The carriage guide member 3 may be placed closer to any one of rollers of the conveyance roller 22 and the tension roller 23. Accordingly, above the conveyance belt 21, there is a relatively large space other than the space where the carriage guide member 3 is placed. Therefore, it is possible to remove the conveyance belt unit easily from the main body of the apparatus to the outside. Further, it is possible to mount the conveyance belt unit easily into the main body of the apparatus by performing the removal process described above in the reverse way.

Figure 10A:
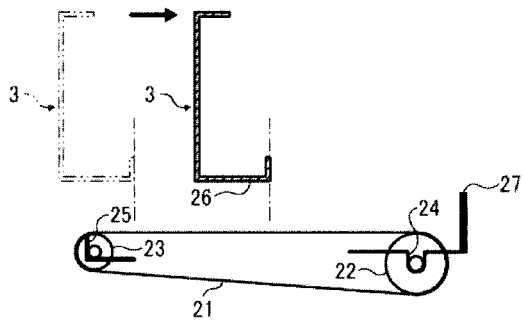
FIGS. 10A and 10B are schematics showing a possible condition to draw out the conveyance belt unit.
Figure 10B:
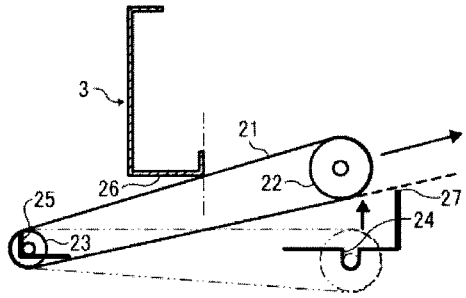

FIGS. 10A and 10B are schematic views of the configuration showing the installation position of the carriage guide member 3 in the sub-scanning direction for the conveyance belt unit to be removed. In FIG. 10A, the position of the carriage guide member 3 shown by the solid line is the installation position moved to the conveying roller 22 side from the installation position of the carriage guide member 3 shown by the dotted line. At the installation position of the carriage guide member 3 shown by the solid line, to remove the conveyance roller 22 from a bearing member 24 of the conveyance belt unit around the tension roller 23 that is the rotational axis, an opening is needed so that the conveyance belt unit is moved to the outside of the apparatus without contacting the conveyance belt unit against the upper edge 27 of the housing and the lower edge 26 of the carriage guide member 3. The installation position of the carriage guide member 3 in the sub-scanning direction, and the distance between the lower edge 26 of the carriage guide member 3 the surface of the conveyance belt unit are set, respectively. Consequently, it is possible to remove the conveyance belt unit easily.

Figure 11:
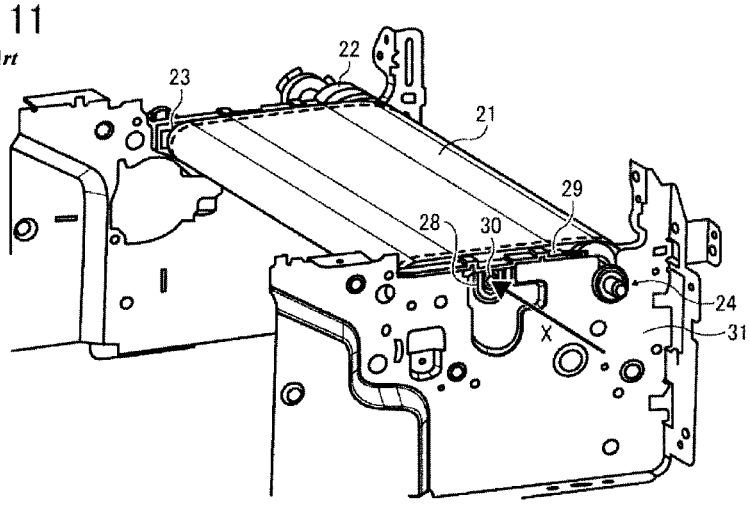
FIG. 11 Prior Art
FIG. 11 is a perspective partial view showing a fastening direction of the conventional conveyance belt unit.
Figure 12A:
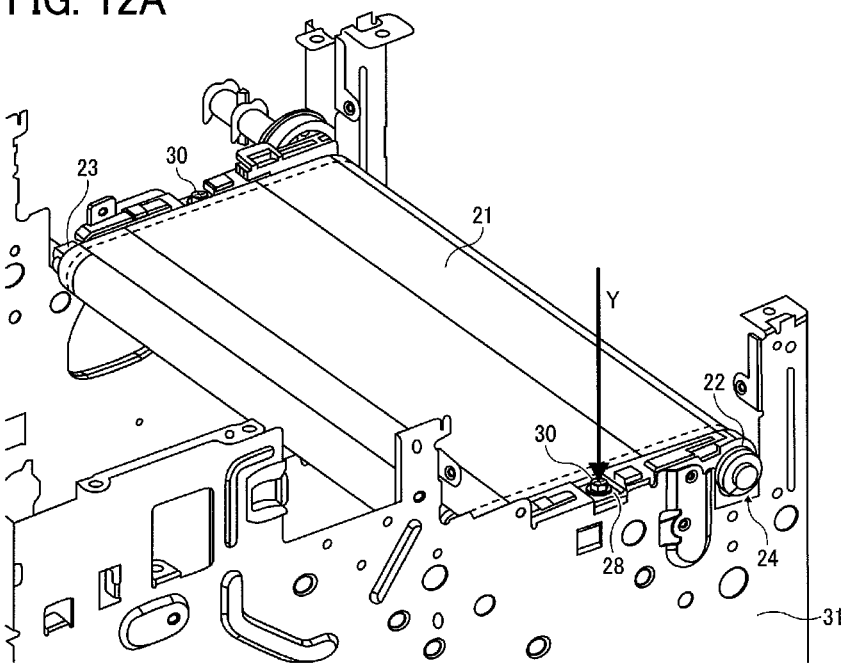
FIGS. 12A and 12B are a perspective partial views showing a fastening direction of the conveyance belt unit of the present invention.
Figure 12B:
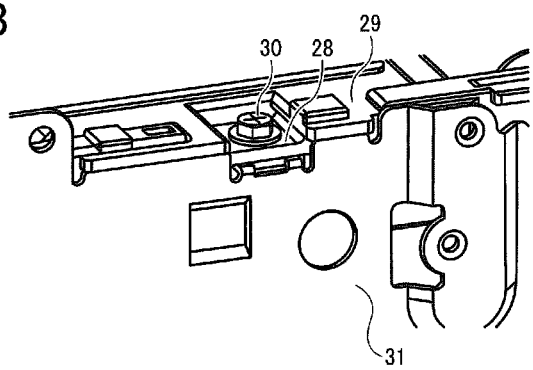

Further, FIG. 11 is a partial perspective view of the conventional conveyance belt unit and a support member to support the conveyance belt unit. As shown in FIG. 11, a fastening unit 28 extending in a direction of the roller shaft from a portion of a holding member 29 to hold the conveyance roller 22 and the tension roller 23, is bent downwards in the substantially vertical direction. Further, a threaded hole is provided to put a screw 30 through on the fastening unit 28. The screw 30 is put through the threaded hole and fastened with a fastened portion (not shown) provided on the support member 31, so that the fastening unit 28 is tightened from the direction shown by the arrow X in FIG. 11. Conventionally, it requires time and effort to remove a side cover (not shown) covering the fastening unit 28, accordingly, the fastening work to fasten the conveyance belt unit to the main body of the apparatus is complicated. By contrast, as shown in FIGS. 12A and 12B, which are partial perspective views of the conveyance belt unit and the support member to support the conveyance belt unit used in the image forming apparatus according to the present embodiment, the fastening unit 28 extends in a direction perpendicular to the conveyance direction of the conveyance belt 21 from a part of the holding member 29. The fastening direction of the screw 30 is a direction shown by arrow Y in FIG. 12A. This fastening direction is roughly the same direction as the direction in which the conveyance belt is removed. It is not shown in FIG. 12A, however, the side cover is not removed. Therefore, without removing the side cover, the fastening portion 28 emerges from the space which presents above the conveyance belt unit after removing the carriage. Accordingly, it becomes easy to remove and mount the screw 30 from or to the fastening portion 28 to be appeared. Consequently, it is possible to mount and remove the conveyance belt unit easily.

Figure 13:
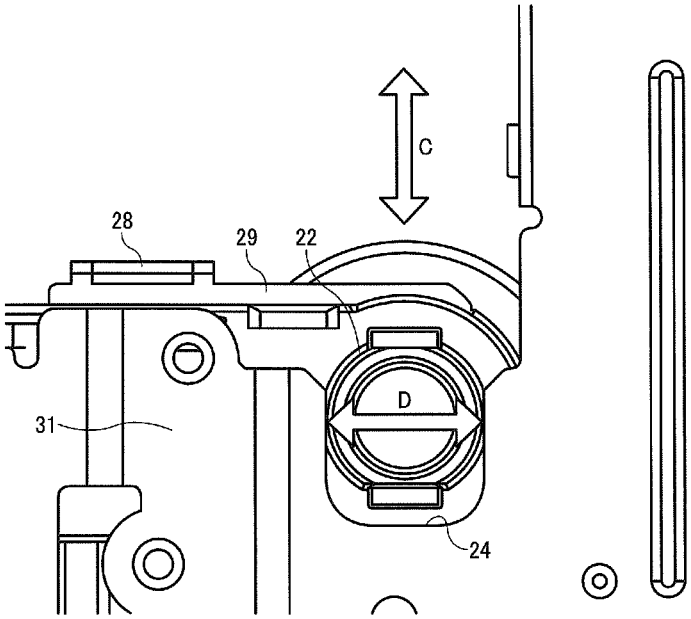
FIG. 13 is a side view showing a configuration of a bearing member of the conveyance belt unit.

Further, as for the bearing member 24 of the conveyance roller 22, as shown in FIG. 13, the positioning of the conveyance roller 22 is performed in a direction (shown by arrow Din FIG. 13) perpendicular to the detaching direction (shown by arrow C in FIG. 13) on a plane perpendicular to the roller shaft. Further, the groove (not shown) provided in the conveyance roller 22 fits with the bottom of the inner wall of the bearing member 24, or the positioning member provided on the holding member of the conveyance belt unit abuts a reference portion (not shown) provided on the support member 31. Accordingly, the parallelism between the belt surface of the conveyance belt 21 and the nozzle surface opposite to the belt surface is determined. The shape of the opening in the bearing member 24 may be a V shapes or some other shape other than the U shape opening shown in FIG. 13.

Figure 14:
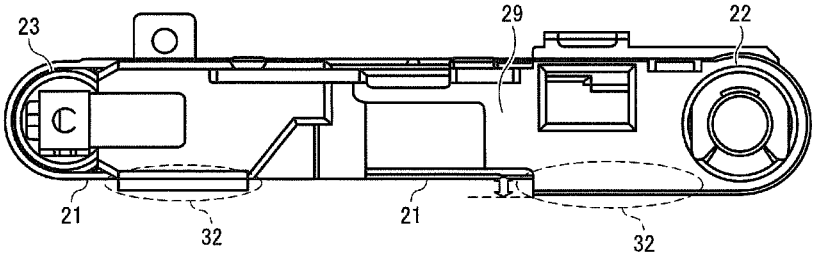
FIG. 14 is a side view showing a configuration of a protruding portion provided in the conveyance belt unit according to the present invention.

Further, as shown in FIG. 14, in the conveyance belt unit, the protruding portions 32 protruding toward the outer side exceeding the outer peripheral surface of the conveyance belt are provided in at least two positions spaced apart from each other at the conveyance roller 22 and the holding member 29 for holding the conveyance roller 22 and the tension roller 23. A step is formed between the edge of the holding member 29 having the protruding portion and the edge of the holding member 29 having no protruding portion 32. Accordingly, when the conveyance belt unit is placed on a flat bench for the replacement work, etc., there is a gap between the belt surface of the of the conveyance belt and the surface of the work bench because there is a step on the holding member 29 of the conveyance belt unit as described above. Therefore, the surface of the conveyance belt does not contact the surface of the work bench. Consequently, it is possible to prevent the belt surface of the conveyance belt from being damaged, or dirtied.

Figure 15A:
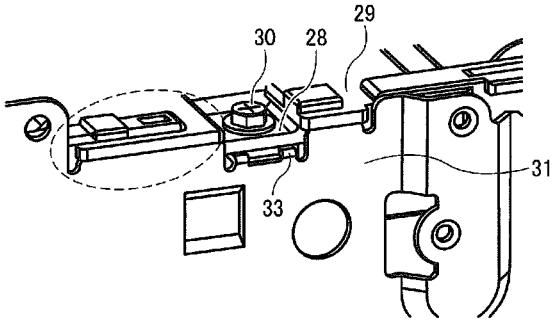
FIGS. 15A, 15B and 15C are schematics showing a configuration of the fastening unit of a support member.
Figure 15B:
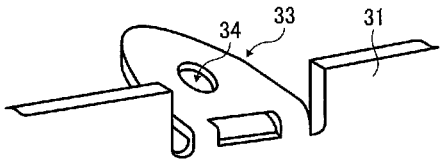
Figure 15C:
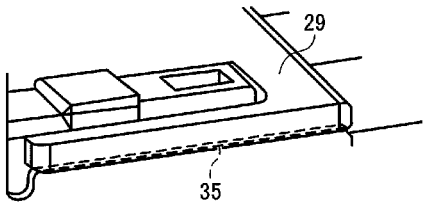

Further, as shown in FIG. 15A, a fastening unit 33 to fasten with the fastening unit 28 of the conveyance belt unit is provided at a part of the supporting member 31. As shown in FIG. 15B, this fastening unit 33 is a member extending vertically from a part of the edge of the supporting member 31, is elastic and is subjected to bending towards the interior of the apparatus. The fastening unit 33 includes a surface facing the fastening surface of the conveyance belt unit 28. This surface includes a hole 34 that accommodates a screw 30. The fastening unit 33 is configured to absorb the axial position deviation of the conveyance roller 22 within the dimensional tolerances for the inclination of the plane including the axis of the roller of the conveyance roller 22 in the conveyance belt and the manufacturing tolerances in the positioning unit 35 that is the abutting portion to abut the upper edge of the support member 31 and the lower end surface of the holding member 29 (refer to FIG. 15C that is an enlarged view of the portion enclosed by the dotted line in FIG. 15A), using the elastic characteristic of the fastening portion 33. Therefore, assembly accuracy can be improved.

Figure 16:
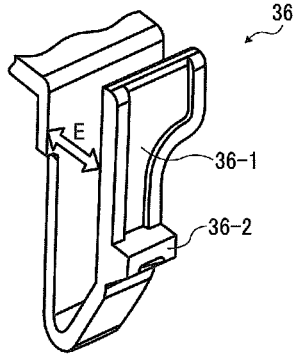
FIG. 16 is a perspective view of another example of the fastening unit of the support member.

Further, the fastening operation between the supporting member of the conveyance belt unit and the holding member is carried out using the screw as shown in FIG. 12A. However, a snap-fit 36 shown in FIG. 16 may be employed. This snap fit 36 is a part of the holding member of the conveyance belt unit and is provided at the edge to face the support member side of the main body of the apparatus. The snap fit 36 includes a claw portion 36-1 which is formed by bending a member extending from the holding member of the conveyance belt unit. The claw portion 36-1 is elastic, and includes a fastening portion 36-2 protruding in a direction to generate elastic force (the direction shown by arrow E in FIG. 16). Two surfaces of the fastening portion 36-2 in the loading direction are tapered to facilitate inserting the protruding portion 36-2 into the opening provided in the support member that is a structure to receive and remove it therefrom. The shape of the opening of the opening portion is approximately identical to the cross-sectional shape in the longitudinal direction of the protruding portion 36-2. The protruding portion 36-2 is fitted into the openings provided in the support member by inserting a claw portion 36-1 into the inner side of the side plate of the support member so that the protruding portion 36-2 is maintained in the openings of the support member by the elastic force of the claw portion 36-1 and the conveyance belt unit is fastened to the supporting member of the main body of the apparatus. Accordingly, ease of removing and mounting work is improved. Further, the screws are no longer needed, therefore, it is possible to expect the cost reduction by reducing the parts.

The apparatus described above provides the following distinctive effects.

[Aspect A]

The cantilevered carriage is removed from the carriage guide member, and the recording medium conveyance means is mounted and removed at a space above the conveyance belt other than the space for the carriage guide member. According to this configuration, as described previously in the embodiment, the conveyance belt unit that is the recording medium conveyance means can be removed easily by simply avoiding the carriage guide member 3. Accordingly, it is possible to shorten the time required to exchange, thereby reducing the costs of replacement.

[Aspect B]

In the apparatus of the aspect A, the recording medium conveyance unit is rotated around one of the pair rollers as an axis and removed from the other roller side through a space above the conveyance belt other than the space for the carriage guide member. According to the configuration, as described previously in the embodiment, by rotating the recording medium conveyance unit around the one roller as the axis, it is possible to mount and remove even if the space for replacement is small.

[Aspect C]

In the apparatus of the aspect A or the aspect B, the recording medium conveyance unit includes a protruding portion that protrudes from the outer peripheral portion of the conveyance belt. According to this configuration, as described previously in the embodiment, when the conveyance belt unit is placed on a bench work, etc., there is a gap between the belt surface of the conveyance belt 21 and the work bench. Accordingly, since the surface of the conveyance belt does not touch the work bench, it is possible to prevent the surface of the conveyance belt from being damaged.

[Aspect D]

In the apparatus according to any one of the aspects A, B and C, a fastening direction in which the recording medium conveyance unit is fastened to a part of the housing is set to a direction substantially equal to the detaching direction of the recording medium conveyance unit. Accordingly, as described previously in the embodiment, since replacement becomes simple, it is possible to shorten the time required to exchange, thereby reducing the costs of the work.

[Aspect E]

In the apparatus of the aspect D, the fastening portion to fasten the recording medium conveyance unit to a part of the housing with the fastening member is elastic. According to this configuration, as described previously in the embodiment, the amount of the fastening member to fasten to the fastening portion that has elastic characteristic is adjusted so that it is possible to adjust the position of the fastening portion to the housing of the recording medium conveyance unit easily.

[Aspect F]

In the apparatus of the aspect D or the aspect E, the fastening member is a screw or a snap fit having the shape of a nail. According to this configuration, as described previously in the embodiment, the screw 30 or the snap fit 36 may be used as the fastening member. Accordingly, replacement becomes simple so that it is possible to shorten the time required to exchange, thereby reducing the costs of the work.

Anther embodiment of an ink jet recording apparatus is described below.

Figure 17:
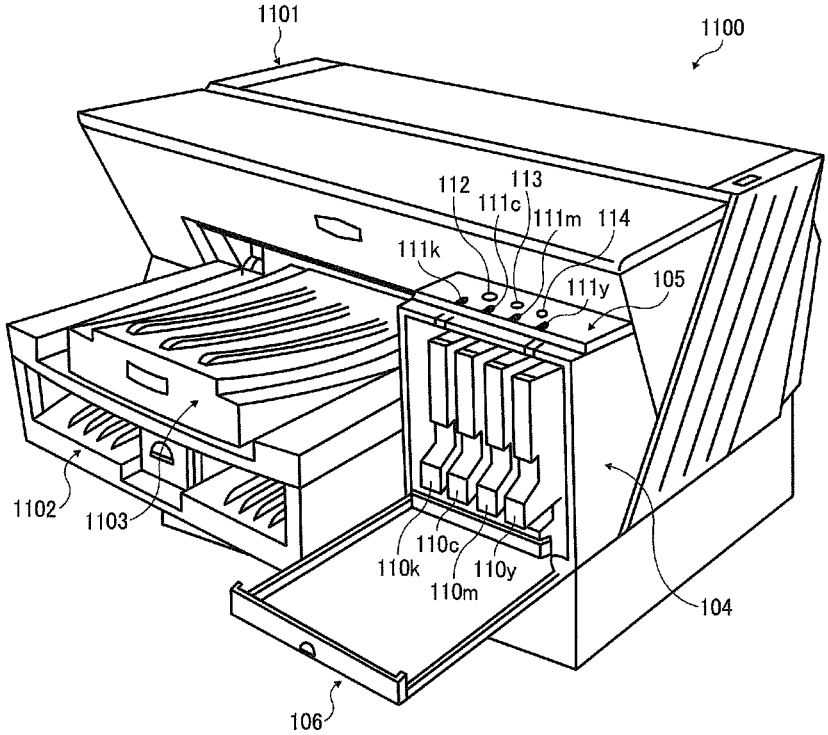
FIG. 17 is a perspective view of an ink jet recording apparatus viewing from the front.

FIG. 17 is a front perspective view of an ink jet recording apparatus. The ink jet recording apparatus 1100 shown in FIG. 17 includes a main body 1101, a recording medium feed tray 1102 to load the recording medium mounted on the main body 1101, and a recording medium output tray 1103 to stock recording mediums on each of which an image is recorded (image formation) and detachably attached to the main body 1101 of the imaging forming apparatus.

Further, at one end portion of the front side of main body 1101 of the image forming apparatus (the side of the recording medium feed tray unit and recording medium output tray unit), a cartridge loading unit 104 protrudes from the front of main body 1101 of the image forming apparatus to the front side to load the ink cartridge disposed at a position lower than the top surface of the cartridge loading unit 104. On the upper surface of the cartridge loading unit 104, an operation and display unit 105 that includes switches and displays is provided.

At this cartridge loading unit 104, a plurality of recording liquid ink cartridges 110*k*, 110*c*, 110*m* and 110*y* (It is referred simply as "ink cartridge 110" when the ink cartridges are not distinguished among the ink cartridges of the different colors) which store a recording liquid (ink) of colors, such as, black (K), cyan (C), magenta (M), yellow (Y), respectively, is loaded by inserting them from the front side toward the rear side of the main body 1101 of the image forming apparatus. At the front side of the cartridge loading unit 104, an openably and closable front cover (cartridge cover) 106 is opened when the ink cartridge 110 is inserted or removed. The ink cartridges 110*k*, 110*c*, 110*m* and 110*y* are configured to be mounted side by side in the transverse direction in the vertical state.

In an operation and display unit 105, at a position corresponding to the mounting position (placed position) of ink cartridge for each color 110*k*, 110*c*, 110*m* and 110*y*, remaining amount display units 111*k*, 111*c*, 111*m* and 111*y* are provided to indicate that the remaining amount in each color ink cartridge 110*k*, 110*c*, 110*m* and 110*y* is at or nearing exhaustion. Further, in this operation and display unit 105, a power switch 112, a recording medium feed and printing restart switch 113, and a cancel switch 114 are provided.

Figure 18:
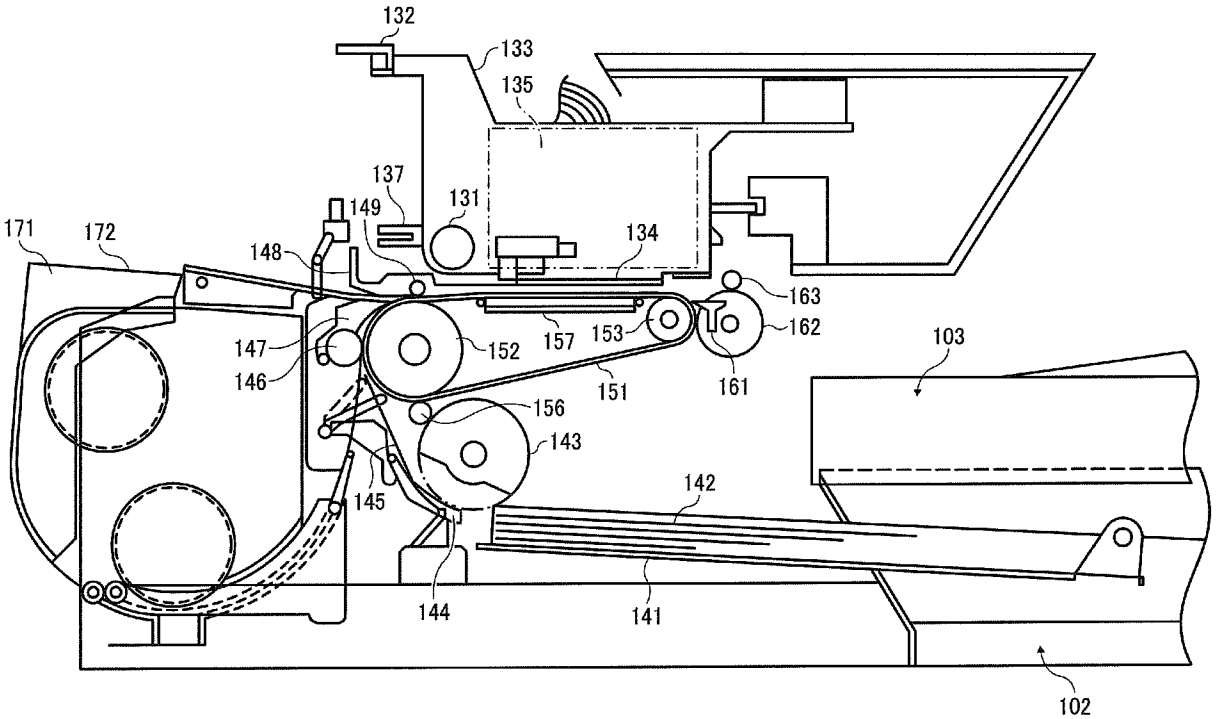
FIG. 18 is a side view showing an outline of the ink jet recording apparatus.
Figure 19:
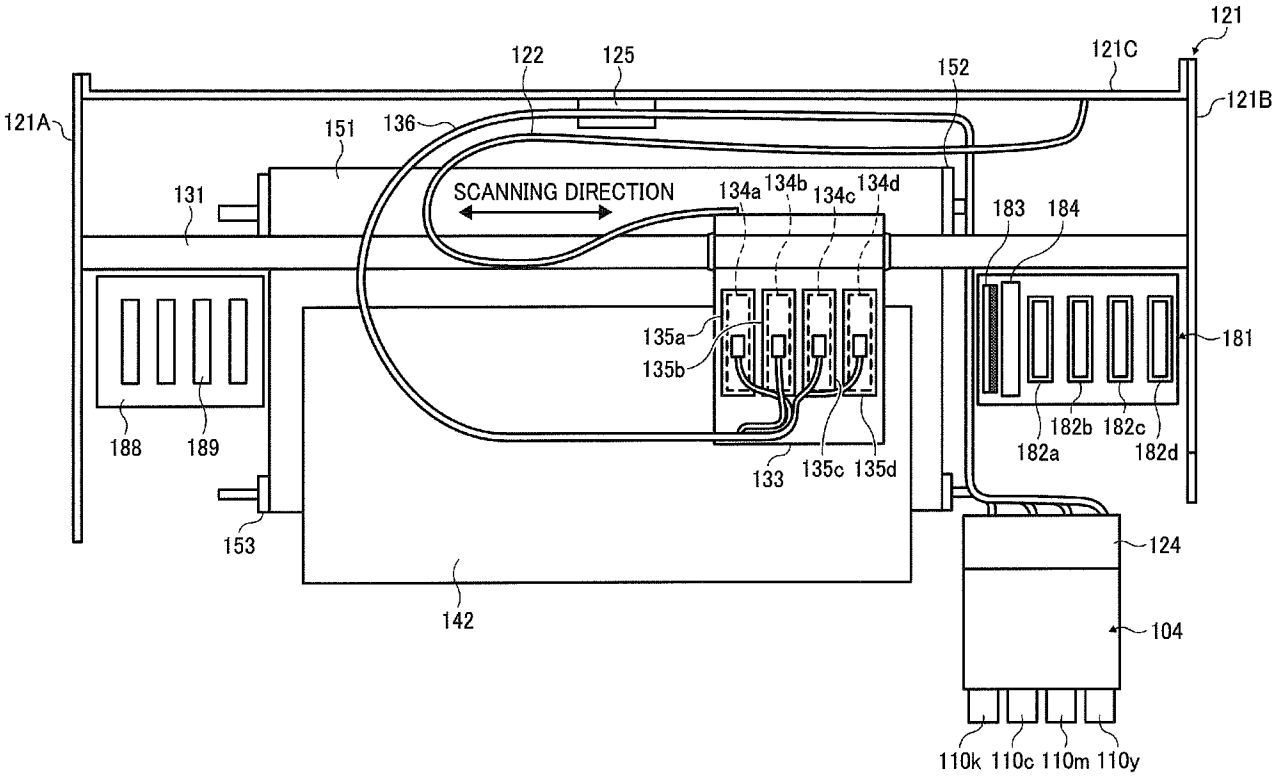
FIG. 19 is a plan view showing a main part of the ink jet recording apparatus.

Next, the mechanical section of the ink jet recording apparatus will be described with reference to FIGS. 18 and 19. FIG. 18 is a side view showing the outline of the mechanical section of the ink jet recording apparatus. FIG. 19 is a plan view showing a main part of the ink jet recording apparatus.

In the mechanical section of the ink jet recording apparatus, the carriage 133 is slidably held in the main scanning direction with the guide rod 131 which is the guide member extended between the left and right side plates 121A and 121B that form a frame 121 and a stay 132. The carriage is reciprocally moved to scan in the carriage main scanning direction indicated by arrow in FIG. 19 through the timing belt by the main scanning motor, not shown.

As for the ink jet head which forms the liquid droplet discharge head 134, an element that includes a piezoelectric actuator such as a piezoelectric element, a thermal actuator using phase-change by the use of boiling film of liquid with an electro-thermal conversion element such as a heating resistor, a shape memory alloy actuator using a thermal metal phase change due to temperature change, or an electrostatic actuator using electrostatic force may be employed to generate the pressure needed for discharging the liquid droplets.

As shown in FIG. 19, the liquid droplet discharge head 134 includes a driver IC which is connected to a control unit (not shown) through a harness (flexible printed cable) 122. Further, in the carriage 133, head tanks 135 for supplying ink of respective colors to the liquid droplet discharge head 134 are mounted. Then, each color of ink is supplied from each color ink cartridge 110*y*, 110*m*, 110*c* and 110*k* mounted on the carriage loading unit 104 to each color head tank 135 through each color supply tube 136, the carriage loading unit 104 includes an ink supply pump unit 124 to feed the ink in the ink cartridge 110, and the ink supply tube 136 is held with the locking member 125 to the rear plate 121C which forms the frame 121 in the middle of a bend in the ink supply tube 136.

Meanwhile, as the recording medium feeding unit for feeding a recording medium 142 loaded on the recording medium loading unit 141 (thick plate) of the recording medium feed tray 102 in FIG. 18, a separation pad 144 formed of a material having a large friction coefficient is provided to face a half-moon-shaped roller (recording medium feed roller) 143 to feed the recording medium 142 one by one separately from the recording medium loading unit 141. The separation pad 144 is biased to the recording medium feed roller 143.

Then, to send the recording medium 142 fed from the recording medium feed unit to the lower side of the liquid droplet discharge head 134, a guide member 145 to guide the recording medium 142, a counter roller 146, a conveyance guide member 147 and a holding member 148 including a leading edge pressure roller 149, and a conveyance belt 151 which is a conveyance means and holds the recording medium 142 by an electrostatic adsorption to convey the recording medium to a position to face the liquid droplet discharge head 134 are provided.

The conveyance belt 151 is an endless belt, extended around a conveyance roller 152 and a tension roller 153, and configured to circulate (in the sub-scanning direction) in a belt conveyance direction. Further, a charging roller 156 that is a charging means to charge the surface of the conveyance belt 151 is provided. The charging roller 156 contacts the surface of the conveyance belt 151, and is provided to be driven to rotate in accordance with the rotation of the conveyance belt 151. Further, on the backside of the conveyance belt 151, a guide member 157 is provided at a position corresponding to the printing area printable by the liquid droplet discharge head 134.

The conveyance belt 151 is rotated in the belt conveyance direction shown in FIG. 19 by causing the conveyance roller 152 being driven to rotate by the sub-scanning motor (not shown) through the timing belt.

Further, as a recording medium output unit to output the recording medium 142 on which an image is recorded by the liquid droplet discharge head 134, a separation claw 161 to separate the recording medium142 from the conveyance belt 151, and recording medium output rollers 162 and 163 are provided. A recording medium output tray 103 is provided underneath the recording medium output roller 162.

Further, a duplex unit 171 is mounted detachably to the rear portion of the main body 1001 of the image forming apparatus. The duplex unit 171 receives the recording medium 142 returned by the reverse rotation of the conveyance belt 151, inverts the recording medium, and feeds it to a position between the counter roller 146 and the conveyance belt 151 again. Further, an upper surface of duplex unit 171 may be used as a manual feed tray 172.

Further, as shown in FIG. 19, a maintenance mechanism 181 including recovery means, which maintains the nozzles of the liquid droplet discharge head 134 in proper condition, is provided at a non-printing area on one side of the carriage 133 in a scanning direction.

The maintenance mechanism 181 includes cap members (hereinafter referred as cap), 182*a* through 182*d* (referred to collectively as "cap 182") to cap respective nozzle surfaces, a wiper blade 183 that is a blade member for wiping each nozzle surface, and a blank discharge receiver 184 to receive a discharge of the liquid droplets that do not contribute to the recording to output thickened recording liquid droplets. In this case, the cap 182*a* is used as the suction and moisturizing cap, and the other caps 182*b*~182*d* are used as the moisturizing cap.

A waste liquid of the recording liquid generated in the maintenance performed by the maintenance mechanism 181, an ink discharged into the cap 182, an ink which is attached on the wiper blade 183 and removed therefrom by the wiper cleaner 185, an ink discharged to the impractical discharge receiver 184 are output into a waste ink tank, not shown, to store.

As shown in FIG. 19, at the non-printing area on the other side of the carriage 133 in a scanning direction, an impractical discharge receiver 188 for receiving a thickened liquid droplet to be discharged which does not contribute to the recording to output during recording is provided, on the impractical discharge receiver 188, an opening 189 is provided along the nozzle column direction of the liquid droplet discharge head 134.

In the ink jet recording apparatus configured as described above, the recording medium 142 is separated and fed from the recording medium feed tray 102 one sheet at a time, the recording medium 142 fed in the upper direction almost vertically is guided by the guide 145, sandwiched between the conveyance belt 151 and the counter roller 146, conveyed with, the leading edge of the recording medium guided by the conveyance guide 147, and pressed to the conveyance belt 151 by the leading edge pressure roller 149, changing the conveyance direction thereof by approximately 90°.

At this time, positive output and negative output are applied alternately from the AC bias supply unit onto the charging roller 156. That is, an alternating voltage is applied. Accordingly, the conveyance belt 151 is charged to possess an alternating voltage pattern, more specifically, alternating positive and negative charge bands are formed with a predetermined width in a sub-scanning direction, that is the circulating direction. When the recording medium 142 is conveyed on the conveyance belt 15 charged to have positive and negative charge bands, the recording medium 142 is adsorbed onto the conveyance belt 151 and is conveyed in the sub-scanning direction by the conveyance belt 151 that is circulating.

Based on the main scanning position information provided by the linear encoder 137, the liquid droplet discharge head 134 is driven in accordance with an image signal while moving the carriage 133 in the main scanning direction, the ink droplets are discharged to record one line on the recording medium 142 being stopped. Then, the recording medium 142 is fed forward a predetermined amount to record the next line. When a recording end signal or a signal indicating that the trailing edge of the recording medium 142 reaches the end of the recording area, the apparatus ends the recording operation and outputs the recording medium 142 to the recording medium output tray 103.

Further, during standby for printing (recording), the carriage 133 is moved to the side of the maintenance mechanism 181. The liquid droplet discharge head 134 is capped with the cap 182 so as to keep the nozzle wet to prevent discharge failure due to dried ink clogging the nozzle from occurring. Further, the recording liquid is suctioned from a nozzle by the suction pump (not shown) under a condition where the liquid droplet discharge head 134 is capped with the cap 182 so as to perform the recovery operation to discharge the thickened recording liquid and bubbles. Further, before recording and while recording, the impractical discharge operation is performed to discharge the ink which does not contribute the recording. With this operation, it is possible to maintain a stable discharge performance of the liquid droplet discharge head 134.

Figure 20:
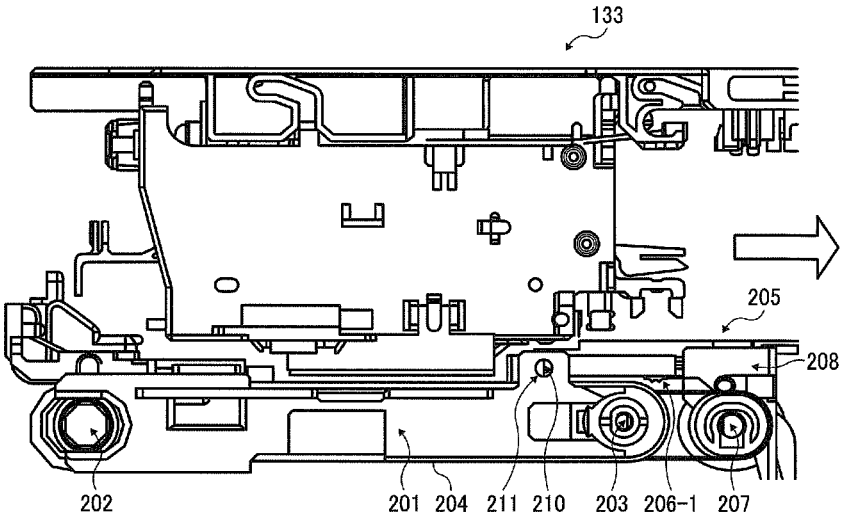
FIG. 20 is a side view showing a configuration of the recording medium conveyance unit and the recording medium output unit of the ink jet recording apparatus.
Figure 21:
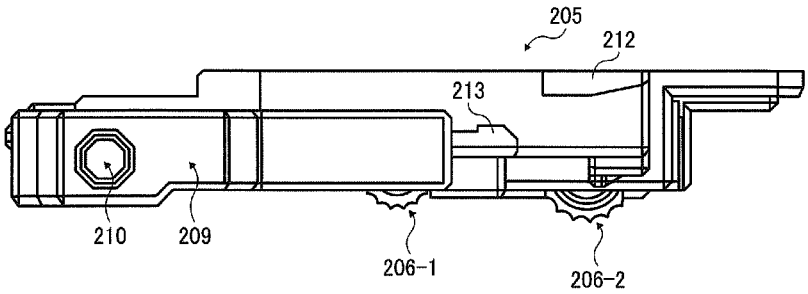
FIG. 21 is a side view of a spur holder.

FIG. 20 is a side view showing a configuration of the recording medium conveyance unit and the recording medium output unit of the ink jet recording apparatus. The conveyance belt guide member 201 holds a conveyance roller 202 and a tension roller 203. The conveyance belt 204 is extended among the conveyance roller 202 and the tension roller 203. At the downstream side in the sheet conveyance direction indicated by arrow in FIG. 20, a spur holder 205 is provided as the recording medium output unit. In the spur holder 205, as shown in FIG. 21 which is a side view of the spur holder and FIG. 22 which is a bottom view of the spur holder, spur rollers 206-1 and 206-2 supported by an elastic body such as a spring, not shown, are arranged in two columns in a direction orthogonal to the recording medium outputting direction. The leading edge of the spur roller 206-2 is located at a position lower than that of the leading edge of the spur roller 206-1. The spur roller 206-1 is provided at a position substantially opposite the end portion of the conveyance belt 204 in the recording medium outputting direction.

Figure 23:
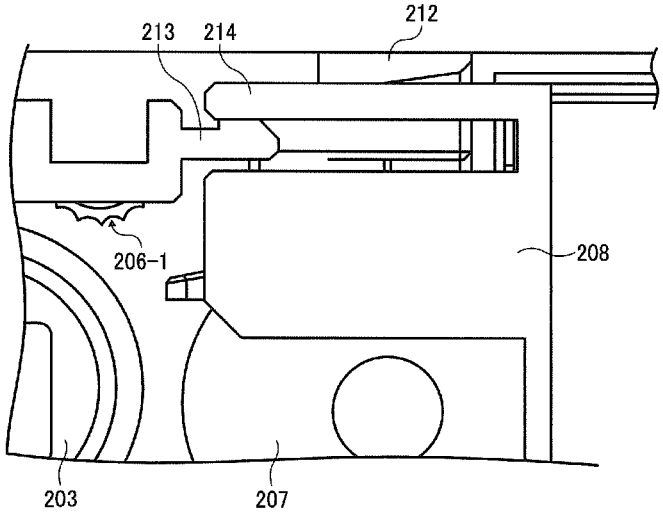
FIG. 23 is a partially enlarged view showing a state in which a regulation member is was fitted to a positioning member of the discharge roller holding member of the spur holder.

FIG. 23 is a partial enlarged view showing a state in which a regulation member of the spur holder is fitted to a positioning member of the recording medium output roller holding member. As shown in FIG. 23, the spur holder 205 includes regulation members having a rail shape, 212 and 213, as the fitting unit, with the positioning member 214 of the recording medium output roller holding member 208 at the forward position in the conveyance direction (downstream side) other than a boss 210 having a cylindrical configuration provided on the side surface of the snap fit 209 as the fitting unit with the conveyance belt guide member 201. The two regulation members 212 and 213 sandwich the upper surface and the lower surface of the positioning member 214 of the recording medium output roller holding member 208 provided on the conveyance belt guide member 201 and are loaded along the respective surface. In other words, the spur holder 205 is regulated at a position in parallel to the axial direction of the spur roller. The recording medium output roller holding member 208 is mounted at a position to regulate the position of the spur holder 205 in the height direction. Since the two regulation members 212 and 213 sandwich the positioning member 214 of the recording medium output roller holding member 208, the spur holder 205 is regulated at a position with respect to the height direction. The recording medium output roller holding member 208 regulates the position of the spur holder 205 in the vertical direction in FIG. 23 so that the position of the spur holder 205 in the vertical direction is stabilized by the recording medium output roller holding member 208. Consequently, the pressure of the spur roller against the recording medium output roller is stabilized.

Further, as shown in FIG. 23, since the leading edge of the regulation member 212 is formed to have a tapered shape, it becomes easy to mount the regulation member 212 to the positioning member 214 of the recording medium output roller holding member 208. In this embodiment, the boss 210 is provided on the side surface of the snap fit 209 and an attachment hole 211 is provided on a side portion of the conveyance belt guide member 201, However, alternatively the attachment hole 211 may be provided on the side surface of the snap fit 209, while the boss 210 may be provided on the side portion of the conveyance belt guide member 201.

Figure 24A:
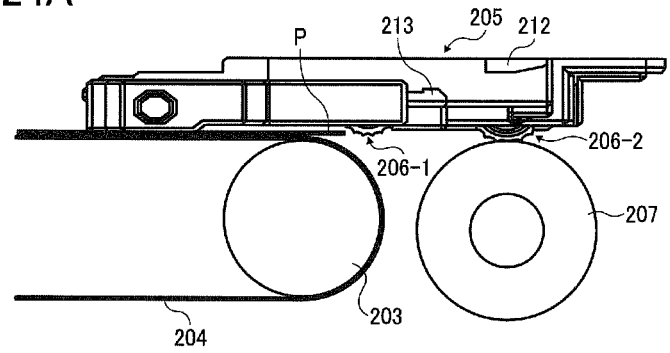
FIGS. 24A, 24B and 24C are schematics showing the recording medium outputting state.
Figure 24B:
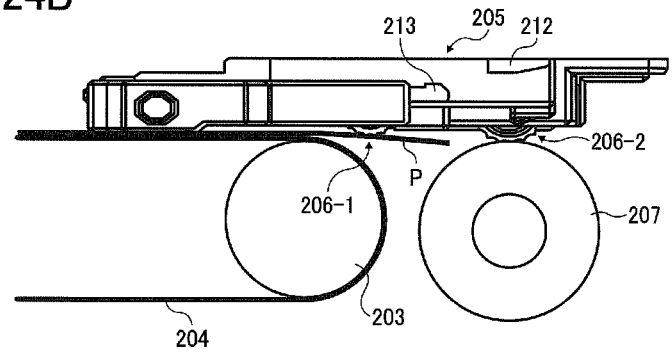
Figure 24C:
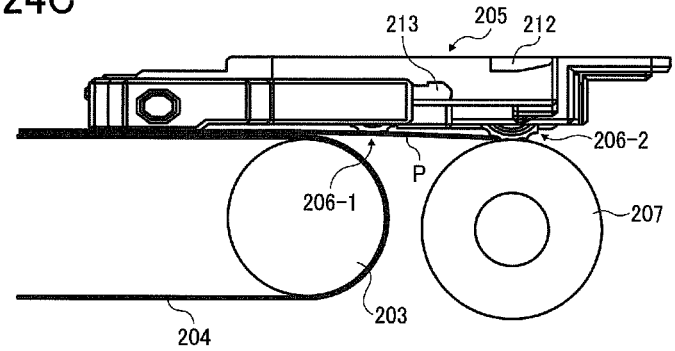

Further, as shown in FIGS. 24A and 24B, the spur roller 206-1 forces the leading edge of the recording medium P projecting toward a space from the end of the conveyance belt 204 downward. Further, the recording medium P is conveyed, and contacts the spur roller 206-2 so as to be guided to a position between the spur roller 206-2 and the recording medium output roller 207 as shown in FIG. 24C.

Figure 22:
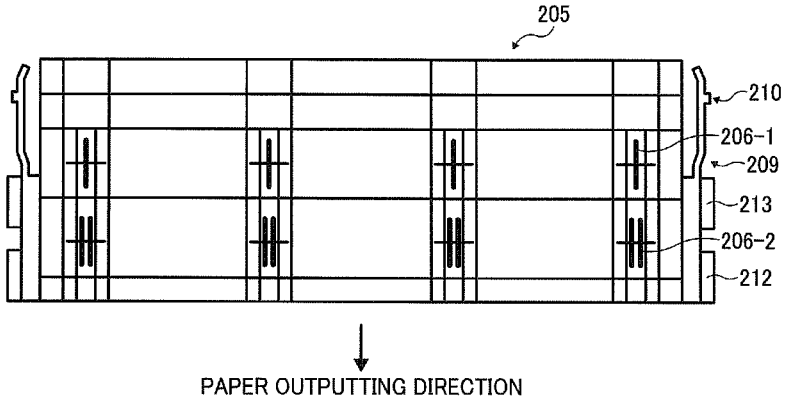
FIG. 22 is a bottom view of a spur holder.

As shown in FIG. 20, the spur holder 205 is fixed to the conveyance belt guide member 201 by the recording medium output roller holding member 208. As for the fixing method, it is configured that the boss 210 having a cylindrical shape and provided on a part of the snap fit 209 having a nail shape is fitted with the attachment hole 211 provided on the side portion of the conveyance belt guide member 201 at both ends of the spur holder 205 perpendicular to the recording medium output direction as shown in FIG. 22. With this configuration, when the spur holder is exchanged, it is easy to remove the spur holder.

Figure 25A:
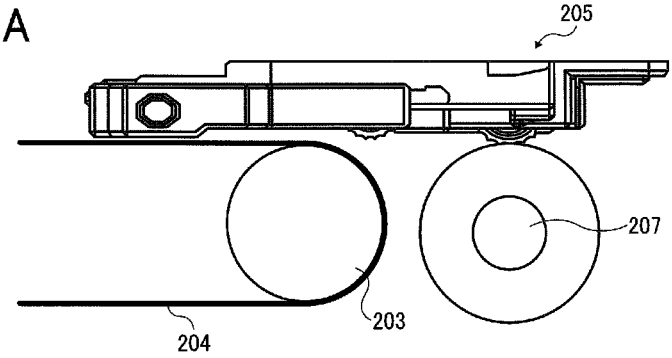
FIGS. 25A, 25B and 25C are schematics showing a state to remove a spur holder.
Figure 25B:
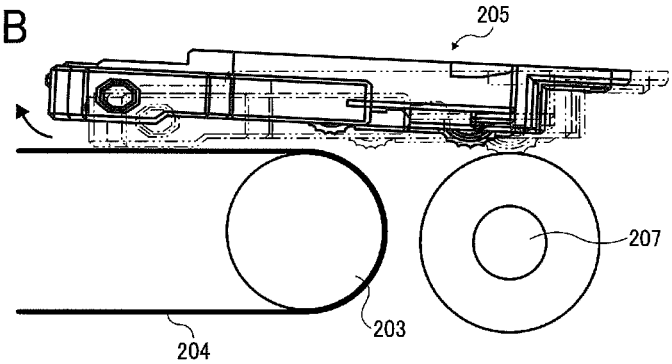
Figure 25C:
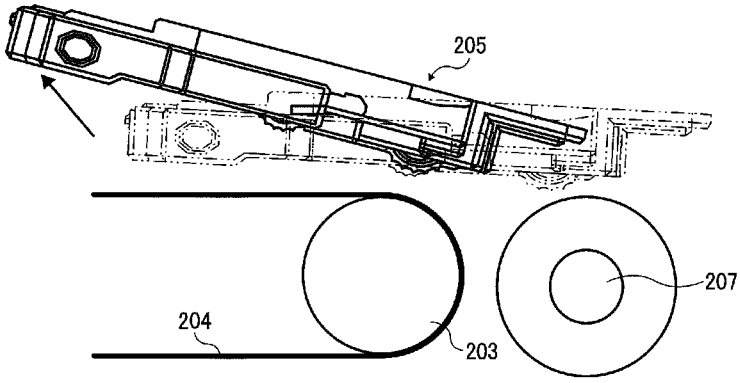

More specifically, as shown in FIGS. 25A, 25B, and 25C, the boss 210 is released from the attachment hole 211, and the spur holder 205 is moved from a position shown by the dotted line to a position shown by a solid line as shown in FIG. 25C. The carriage positioned above the belt conveyance belt 204 is removed, or is moved to the standby position so that the spur holder 205 is lifted upward into the space spreading in the upper side of the conveyance belt 204 by sliding and drawing in a direction opposite to the conveyance direction. By providing the spur holder detachably in this way, it is possible to replace the conveyance belt unit more easily, for example, when the ink is dripped on the conveyance path and the conveyance belt is damaged while fixing the recording medium jam. In this case, the carriage 133 mounting the ink jet recording head and provided above the conveyance belt unit is removed from the guide rod. Then, similarly to described above, the spur holder 205 present in part of the space to draw out the belt conveyance unit is drawn out. Each boss 210 of the spur holder 205 is removed from the respective attachment hole 211. With this process, it is possible to eliminate the obstacle in the space to draw out the conveyance belt unit. Accordingly, it becomes easy to detach the conveyance belt unit. Also, a single spur holder can be exchanged separately. Further, it is possible to perform a special operation, for example, an operation to replace the spur roller depending on the thickness of recording medium to be selected by the user.

Figure 26:
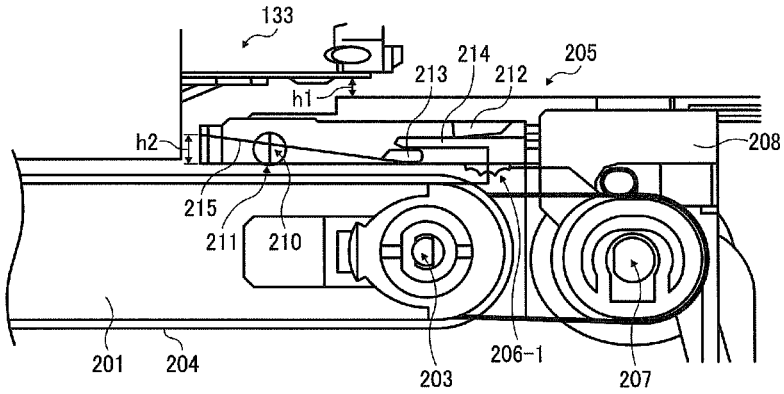
FIG. 26 is a side view of another spur holder.

FIG. 26 is a schematic view of another configuration of the spur holder. In FIG. 26, identical reference characters are assigned to identical or similar members in FIG. 21. In the spur holder 205 in FIG. 26, the snap fit 209 and the regulation members 212 and 213 having a rail shape are fitted detachably only to the conveyance belt guide member 201. More specifically, the attachment holes 211 and the positioning member 214 are provided in the conveyance belt guide member 201, the boss 210 of the snap fit 209 is fitted to the attachment hole 211, and he positioning member 214 is sandwiched by the regulation members 212 and 213. The gap between the nozzle surface of the recording head and the belt surface of the conveyance belt are needed to be regulated strictly because it affects the discharge performance. Accordingly, the conveyance belt guide member 201 to hold the conveyance belt is disposed with good accuracy. The conveyance belt guide member 201 is positioned to the apparatus with a high accuracy. In order to convey the recording medium after image formation smoothly to the side of the recording medium output roller, the relative position of the roller surface of the recording medium output roller and the belt surface of the conveyance belt is regulated strictly. The spur holder 205 is fitted detachably only to the conveyance belt guide member 201 so that the relative position of the roller surface of the recording medium output roller and the belt surface of the conveyance belt can be set accurately. Further, the gap h1 in the FIG. 26 between the carriage 133 mounted to fix the recording head at a predetermined position and the spur holder 205 can be regulated to a predetermined value. Therefore, it is possible to set the height between the recording head and the recording medium entry port of the spur holder as large as possible (height h2 in FIG. 26). By this configuration, as shown in FIG. 26, it is possible to provide a large opening between the recording medium guide surface 215 having a tapered shape and the belt surface of the conveyance belt as large as possible. Further, it is possible to prevent the leading edge of the recording medium from entering the gap between the spur holder 205 and the carriage 133, thereby enabling to guide the recording medium to be output to the spur roller 206-1 smoothly.

The apparatus described above is an example, the apparatus according to the present invention exerts the specific effect in each following aspect.

[Aspect A]

When the attachment hole is provided on a side of the spur holder at a position corresponding to the boss at a part of the conveyance belt holding member which holds a pair of the conveyance rollers around which the conveyance belt is extended, or at a part of the recording medium output roller holding member which holds the recording medium output roller, the boss to fit with the attachment hole is provided. Or, when the boss is provided at a part of the conveyance belt holding member or at a part of the recording medium output roller holding member, a snap fit nail which is elastic and has an attachment hole to fit with the boss and a regulation member which regulates the swinging position around the boss and the attachment hole by catching the positioning member provided at a part of the recording medium output roller holding member or at a part of the conveyance belt holding member are provided.

With this configuration, as the embodiment described above, the spur holder 205 is mounted detachably to the recording medium output roller holding member 208 or the conveyance guide member 201 by the snap fit nail 209 and the regulation portion provided on the spur holder 205. The conveyance guide member 201 and the recording medium output roller holding member 208 are disposed to the apparatus at a predetermined position with high accuracy. This is to regulate the relative position between the belt surface of the conveyance belt 204 and the roller surface of the recording medium output roller 207 to convey the recording medium smoothly to the recording medium output roller side by the recording medium output roller conveyance belt 204 after image forming. Thus, the spur holder 205 is attached detachably to the conveyance guide member 201 or the recording medium output roller holding member 208 disposed at a position to the apparatus with high accuracy. Accordingly, the relative position between the spur rollers 206-land 206-2 of the spur holder 205 and the recording medium conveyed to the recording medium output roller 207 from the spur rollers 206-land 206-2 of the spur holder 205 and the conveyance belt 204 is regulated with high accuracy. Consequently, it is possible to provide the power of the spur roller to convey the recording medium stably and minimize the trace of the spur rollers, thereby preventing the failure of the image forming from occurring regardless of time. And, it is possible to remove the spur holder by deforming the snap fit nail. As a result, it becomes easy to replace the spur holder without requiring the effort of fastening and releasing the fastening means such as a screw, etc. differently from the procedure disclosed in the patent document, JP 2006-301335A.

[Aspect B]

In the configuration of the aspect A, the regulation portion has a rail shape and includes retainers which sandwich the positioning member. According to this configuration, as described above in the embodiment, the regulation members having a rail shape 212 and 213, that are the sandwiching member which sandwich the upper surface portion and bottom surface portion of the positioning member 214 which is a member extending in the longitudinal direction, provided in the conveyance guide member 201 and the regulation members are loaded along the respective surface. Since the mounting position of the positioning member 214 is a position to determine the position of the spur holder in the height direction, it is possible to regulate the position of the spur holder with respect to the height direction.

[Aspect C]

In the configuration of the aspect B, the spur holder is mounted and removed by sliding it in the conveyance direction along the rail shape. According to this configuration, as described above in the embodiment, it is possible to mount and remove the spur holder easily by sliding it without disassembling the apparatus.

What is claimed is:

1. An image forming apparatus comprising:

a carriage configured to mount a recording head which discharges a liquid droplet on a recording medium to form an image;

a carriage guide member configured to support the carriage detachably and move the carriage to scan in a main scanning direction orthogonal to a sub-scanning direction in which the recording medium is conveyed; and a recording medium conveyance unit detachably mounted to a main body of the apparatus, comprising:

an endless conveyance belt to convey the recording medium being adsorbed on the belt; and a pair of rollers around which the conveyance belt is extended circulating in the subscanning direction, wherein the carriage is supported only by the carriage guide member, the carriage guide member being planar and contacting an outer surface of the carriage, and wherein the recording medium conveyance unit is removable from a space above the conveyance belt, in an area other than the carriage guide member.

2. The image forming apparatus according to claim 1, wherein he recording medium conveyance unit is removable from a driven roller side of the recording medium conveyance unit.

3. The image forming apparatus according to claim 1, wherein the recording medium conveyance unit includes a protruding portion that protrudes from an outer peripheral portion of the conveyance belt.

4. The image forming apparatus according to claim 1, further comprising a fastening member o fasten the recording medium conveyance unit to a part of a main body of the apparatus in a direction substantially identical to a direction in which the recording medium conveyance unit is detachable.

5. The image forming apparatus according to claim 4, wherein a fastening portion to fasten the recording medium conveyance unit with the fastening member to a part of a main body of the apparatus is elastic.

6. The image forming apparatus according to claim 4, wherein the fastening member is one of a screw and a snap fitting having a nail shape.

7. The image forming apparatus according to claim 1, further comprising:

a recording medium output roller configured to output the recording medium on which an image is formed by discharging a recording liquid droplet onto the recording medium;

a spur holder;

a spur roller provided opposite to the recording medium output roller in the spur holder and supported by an elastic body to output the recording medium together with the recording medium output roller; and a boss and an attachment hole engaging the boss, wherein when the attachment hole is provided at a part of the conveyance roller holding member which holds a pair of rollers at a position corresponding to the boss, the boss is provided on a side of the snap fit nail which is elastic and provided in the spur holder, or when the boss is provided at a part of the conveyance roller holding member, the snap fit nail which is elastic and has the engagement hole is provided on a side of the spur holder.

8. The image forming apparatus according to claim 7, further comprising:

a recording medium output roller holding member to hold the recording medium output roller;

a positioning member provided in one of a part of the recording medium output roller holding member and a part of the conveyance roller holding member; and a regulation member to regulate a swinging position around the boss and the attachment hole by catching the positioning member.

9. The image forming apparatus according to claim 8, wherein the regulation member has a rail shape and includes a retainer to retain the positioning member.

10. The image forming apparatus according to claim 9, wherein the spur holder is removed and attached by sliding the retainer having a rail shape in the conveyance direction.

11. The image forming apparatus according to claim 1, wherein the carriage guide member cantilevers the carriage.

* * * * *